US006106362A

United States Patent [19]

Keller et al.

[11] Patent Number: 6,106,362

[45] Date of Patent: Aug. 22, 2000

[54] TOY VEHICLE HAVING AN OSCILLATING BODY

[75] Inventors: Bryan R. Keller; Robert L. Brown, both of Cincinnati, Ohio

[73] Assignee: Hasbro, Inc., Pawtucket, R.I.

[21] Appl. No.: 09/123,683

[22] Filed: Jul. 28, 1998

[51] Int. Cl.[7] ..... A63H 17/00

[52] U.S. Cl. ..... 446/456; 446/457; 446/470

[58] Field of Search ..... 446/437, 448, 446/456, 457, 465, 470

[56] References Cited

U.S. PATENT DOCUMENTS

| | | | |
|---|---|---|---|
| 3,101,569 | 8/1963 | Giradina . | |
| 4,188,750 | 2/1980 | Lohr . | |
| 4,269,596 | 5/1981 | D'Andrade | 434/32 |
| 4,421,485 | 12/1983 | Geschwender | 434/32 |
| 4,457,099 | 7/1984 | Kozuka et al. | 446/437 |
| 4,488,375 | 12/1984 | Cheng | 446/470 X |
| 4,536,167 | 8/1985 | Hughes | 446/396 |
| 4,666,420 | 5/1987 | Nagano | 446/443 |
| 4,695,266 | 9/1987 | Hui | 446/454 |
| 4,846,758 | 7/1989 | Chou | 446/437 |
| 4,932,913 | 6/1990 | Raviv et al. | 446/7 |
| 4,987,349 | 1/1991 | Nakamura | 318/283 |
| 5,088,949 | 2/1992 | Atkinson et al. | 446/3 |
| 5,127,658 | 7/1992 | Openiano . | |
| 5,173,072 | 12/1992 | Ozawa | 446/462 |
| 5,203,563 | 4/1993 | Loper, III . | |
| 5,216,337 | 6/1993 | Orton et al. | 318/16 |
| 5,259,808 | 11/1993 | Garr | 446/437 |
| 5,273,478 | 12/1993 | Yamasaki | 446/409 |
| 5,322,469 | 6/1994 | Tilbor | 446/470 X |
| 5,482,494 | 1/1996 | Ishimoto | 446/456 |
| 5,609,510 | 3/1997 | Stubenfoll et al. | 446/437 X |
| 5,643,041 | 7/1997 | Mukaida | 446/455 |

FOREIGN PATENT DOCUMENTS

| | | | |
|---|---|---|---|
| 2 187 650 | 9/1987 | United Kingdom . | |
| 2249735 | 5/1992 | United Kingdom | 446/437 |

OTHER PUBLICATIONS

TOMY®Big Fun R/C Turbo Sports Car Hands–on wheel control steers just like a real car!Photographs 1995 Copyright engraved.

*Primary Examiner*—John A. Ricci

*Attorney, Agent, or Firm*—Marshall, O'Toole, Gerstein, Murray & Borun

[57] ABSTRACT

A toy vehicle having a hinged body that oscillates in response to the operation of a motor drive assembly. The toy vehicle includes a chassis having a plurality of wheels, a motor drive assembly mounted to the chassis and being operatively connected to at least one of the wheels, a body mounted to the chassis by a hinge, and an actuating cam operatively connected to the motor drive assembly and engaging the body. The hinge permits the body to move about the hinge, and the actuating cam thus imparts pivotal movement to the body about the hinge in response to operation of the motor drive assembly.

17 Claims, 8 Drawing Sheets

TOY VEHICLE HAVING AN OSCILLATING BODY

FIELD OF THE INVENTION

The present invention relates generally to a toy vehicle having a body which oscillates in response to the operation of a drive motor.

BACKGROUND AND SUMMARY OF THE INVENTION

Toy vehicles, including remote controlled or radio controlled toy cars and trucks, are generally well known in the art. Such toy vehicles typically include a battery operated motor, a steering mechanism, and a wireless controller that enables the vehicle to be operated untethered. Most children find the motor driven, remote controlled aspect of such as toys very appealing because the features satisfy a child's desire for realism. However, because of the wide variety of such toy vehicles on the market, such toy vehicles must have increasingly complex and realistic features in order capture and stimulate a child's imagination.

The toy vehicle according to the present invention incorporates an oscillating body adapted to simulate the continuous rocking and rolling experienced by the body of an actual vehicle being driven over rough terrain. The incorporation of this and other complex and realistic features greatly enhances the play value of the toy.

According to one aspect of the invention, a toy vehicle includes a chassis having a plurality of wheels, a motor drive assembly mounted to the chassis and being operatively connected to at least one of the wheels, a body mounted to the chassis by a hinge, and an actuating cam operatively connected to the motor drive assembly and engaging the body. The hinge permits the body to move about the hinge, and the actuating cam thus imparts pivotal movement to the body about the hinge in response to operation of the motor drive assembly.

The actuating cam may include a plurality of lobes, such as three. Preferably, the actuating cam may include a pair of cam members mounted to a common camshaft, with each of the cam members including one or more cam lobes. The lobes of each cam member may be staggered about the camshaft relative to the lobes of the other cam member. Each of the cam member lobes are disposed to abut an adjacent side portion of the body, thereby alternately pivoting the body about the hinge in opposite directions as the cam shaft repeatedly rotates. The actuating cam may be connected to the motor drive assembly so as to pivot the body about the hinge at a rate proportional to a speed of the vehicle.

The hinge includes a front pivot mounted adjacent a front end of the chassis and a rear pivot mounted adjacent a rear end of the chassis. A cam follower may be mounted to the body in a position to engage the actuating cam, such as adjacent the rear of the vehicle.

The toy vehicle will preferably include a remote controller, such as an RC controller, to enable the vehicle to be remotely operated by the user. The RC controller is preferably shiftable between a forward mode and a reverse mode.

In accordance with another aspect of the invention, a toy vehicle comprises a chassis having a plurality of wheels, a motor carried by the chassis, a gear train operatively connecting the motor to at least one of the wheels, a body mounted to the chassis by a pivot, and an actuator operatively connected to the gear train. The actuator engages the body, such that the actuator moves the body about the pivot in response to operation of the motor.

In accordance with yet another aspect of the invention, a toy vehicle having an oscillating body includes a chassis having a plurality of wheels, a drive motor operatively connected to at least one of the wheels for propelling the vehicle along a path, and a body mounted to the chassis by a pivot assembly. An actuator operatively connects the drive motor and the body. The actuator is adapted to oscillate the body about the hinge assembly in response to operation of the drive motor.

The aforementioned features and advantages, in addition to other features and advantages, will become readily apparent to those skilled in the art upon a reading of the following detailed description.

DETAILED DESCRIPTION OF THE PREFERRED EMBODIMENT

Figure 1:
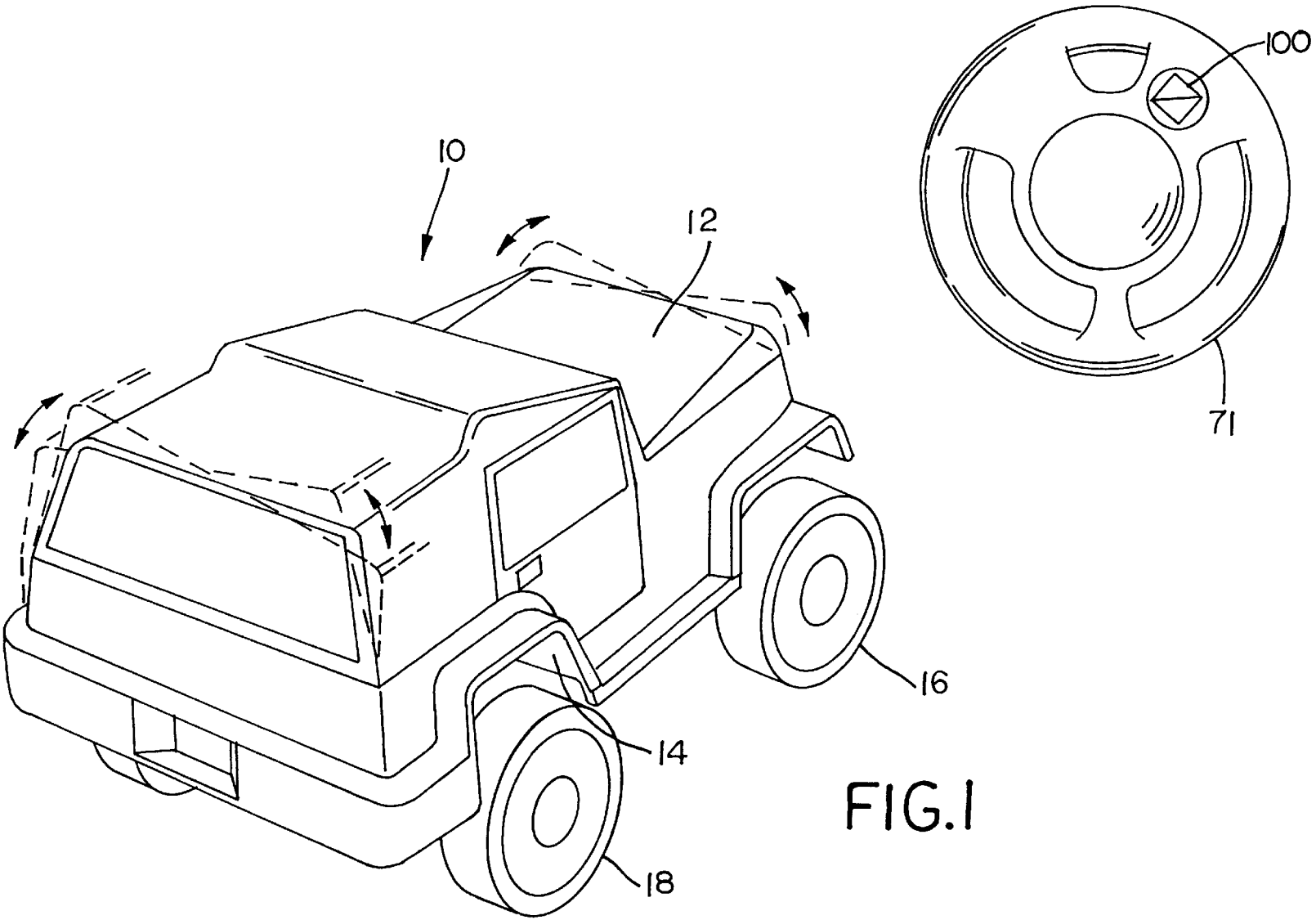
FIG. 1 is a perspective view of a toy vehicle constructed in accordance with the teachings of the present invention along with a hand held RC controller.

The embodiment described herein is not intended to be exhaustive or to limit the scope of the invention to the precise form disclosed. The following embodiment has been chosen and described in order to best explain the principles of the invention and to enable others skilled in the art to follow its teachings.

Referring now to the drawings, a toy vehicle constructed in accordance with the teachings of the present invention is generally referred to by the reference numeral 10. The toy vehicle 10 includes a body 12 mounted on a chassis 14 supported by a pair of front wheels 16 and a pair of rear wheels 18. As shown in FIGS. 4–7, a motor drive assembly 20 is mounted to the chassis 14.

Figure 6:
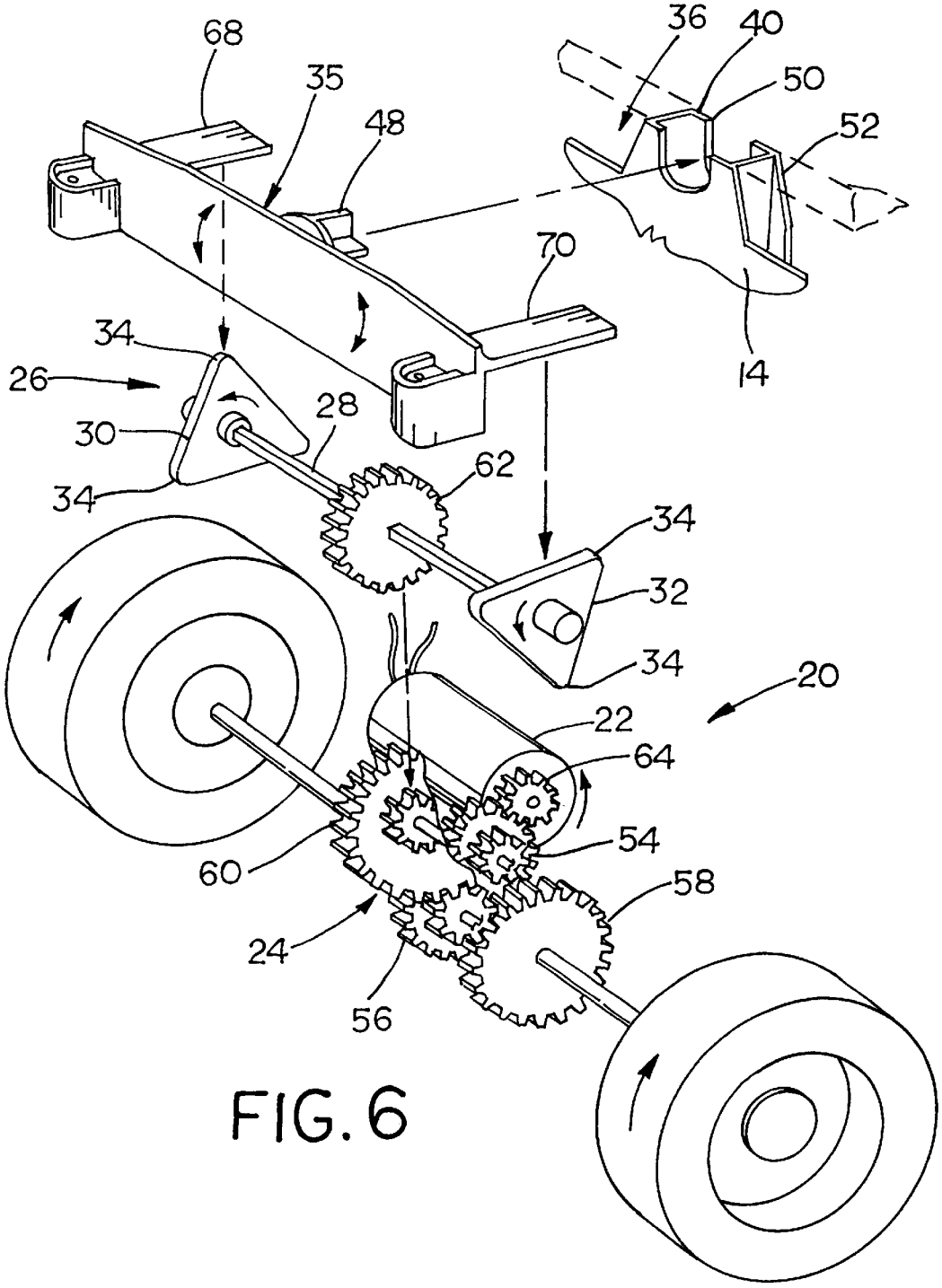
FIG. 6 is an enlarged view in perspective of the motor drive assembly and the actuating cam.
Figure 7:
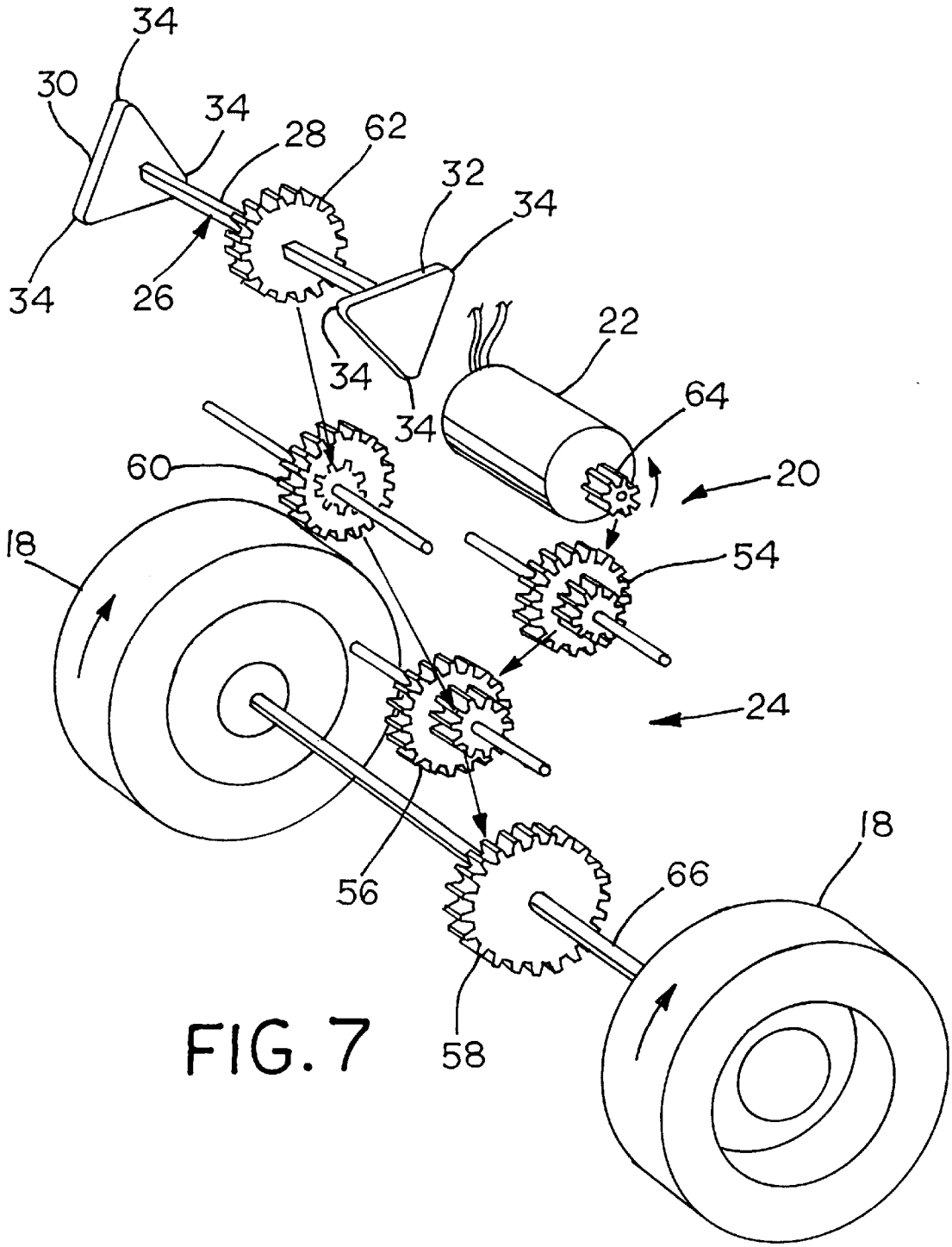
FIG. 7 is an exploded view in perspective of the motor drive assembly and the actuating cam shown in FIG. 6.

As in FIGS. 6 and 7, the motor drive assembly 20 includes an electric drive motor 22 powered by one or more batteries (not shown) in a conventional manner. The motor drive assembly 20 is connected to the rear wheels 18, such as by a gear train 24. Alternatively, the motor drive assembly 20 could be connected to the front wheels. An actuating cam assembly 26 having a rotatable shaft 28 and a pair of cam members 30, 32 is connected to and driven by the gear train 24. Each of the cam members 30, 32 is generally triangular in shape and includes a plurality of cam lobes 34, with three (3) such cam lobes 34 being shown on each cam member 30, 32. Additional or fewer cam lobes may be provided. More cam lobes will cause the body 12 to tilt or oscillate back and forth at a greater rate for a given final drive ratio, while fewer cam lobes will cause the body to tilt or oscillate back and forth at lesser rate for the same final drive ratio. Consequently, for a given final drive ratio, the rate of the tilting action of the body 12 will be proportional to the speed of operation of the toy vehicle 10.

As an alternative to the triangular shaped cam members shown, a more traditional rounded or elliptical shaped cam profile may be chosen. As can be seen in FIGS. 6 and 7, the cam lobes 34 of each cam member 30, 32 are offset relative to the shaft 28, and are positioned to abut a cam follower 35 (shown in FIG. 5) mounted to the body 12 as will be explained in greater detail below.

Figure 2:
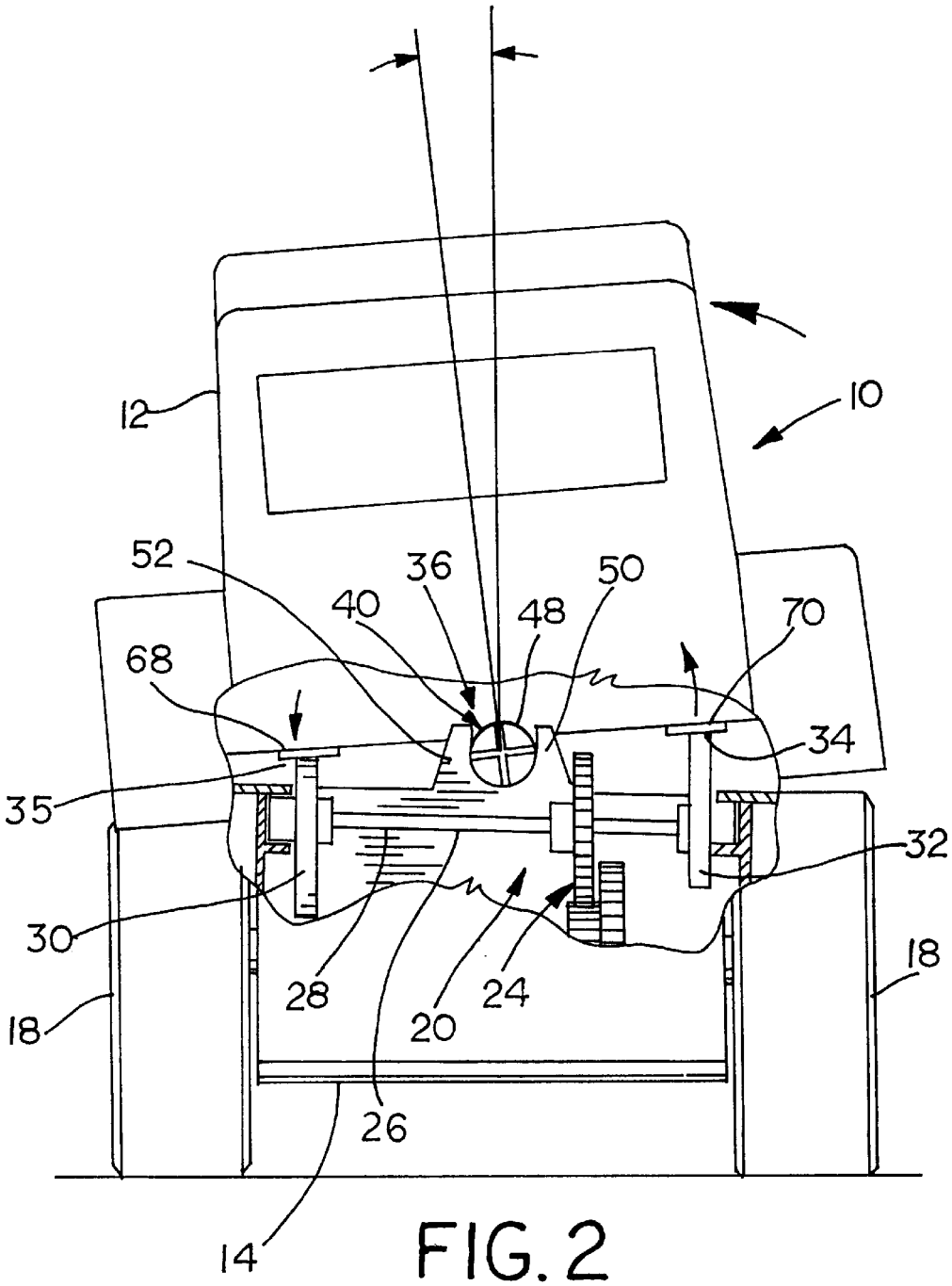
FIG. 2 is a rear end elevational view, partly in section, of the toy vehicle shown in FIG. 1 and showing the body tilted to the left.
Figure 3:
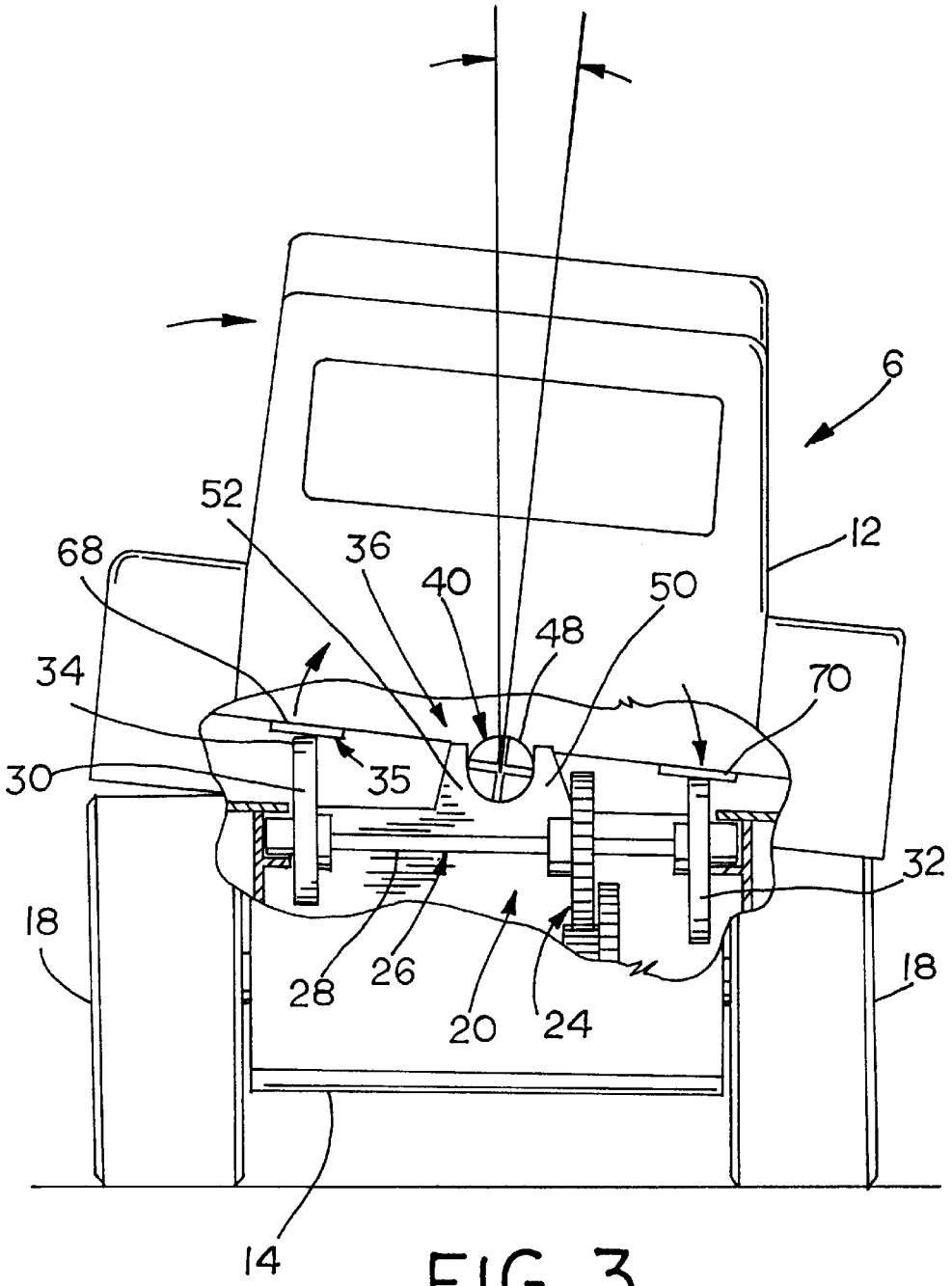
FIG. 3 is a rear end elevational view similar to FIG. 2 but showing the body tilted to the right.
Figure 4:
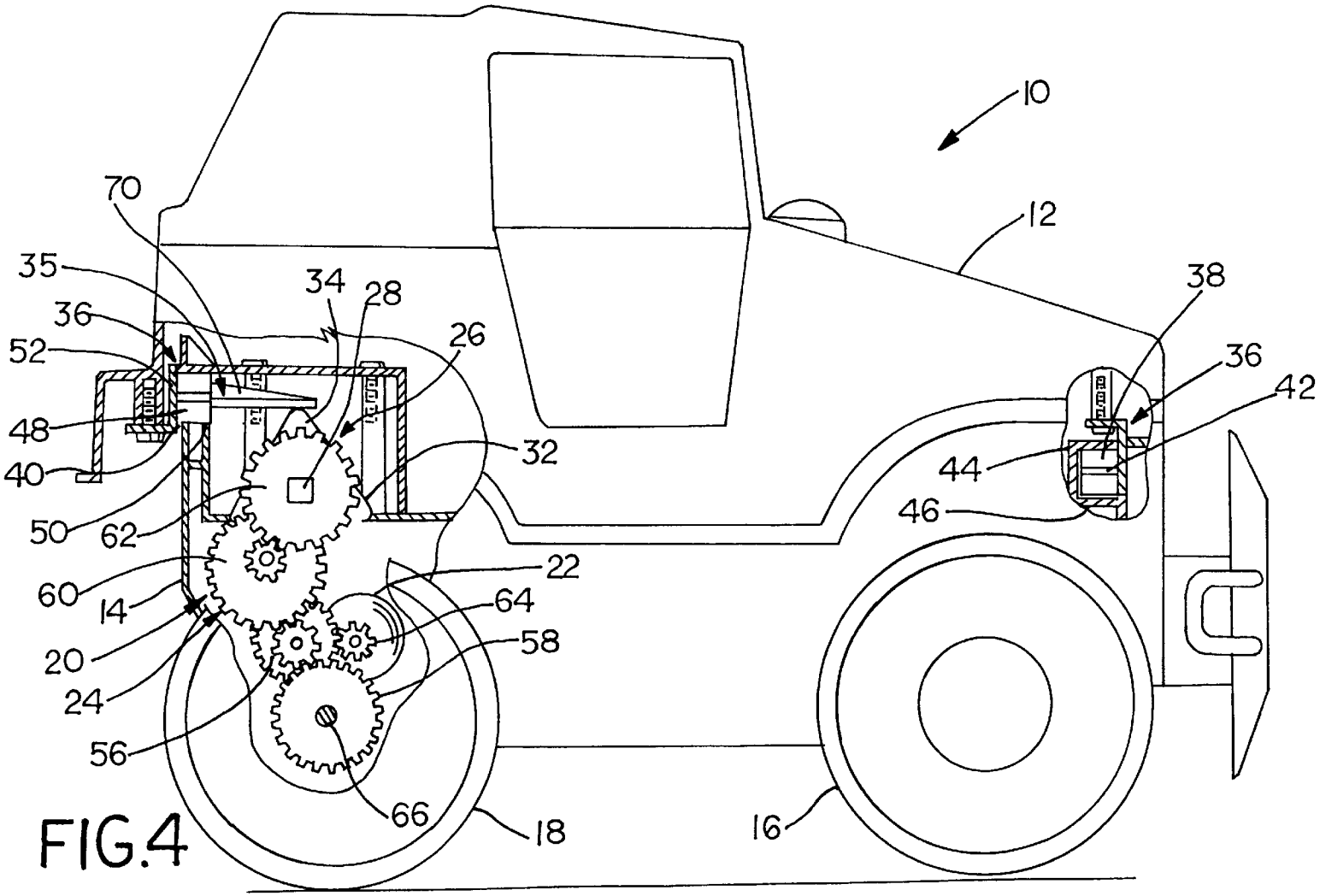
FIG. 4 is a side elevational view of a toy vehicle with portions of the body cut away to reveal the motor drive assembly for propelling the toy vehicle along with the actuating cam connected thereto for tilting the vehicle body as the toy vehicle is moved over a surface.
Figure 5:
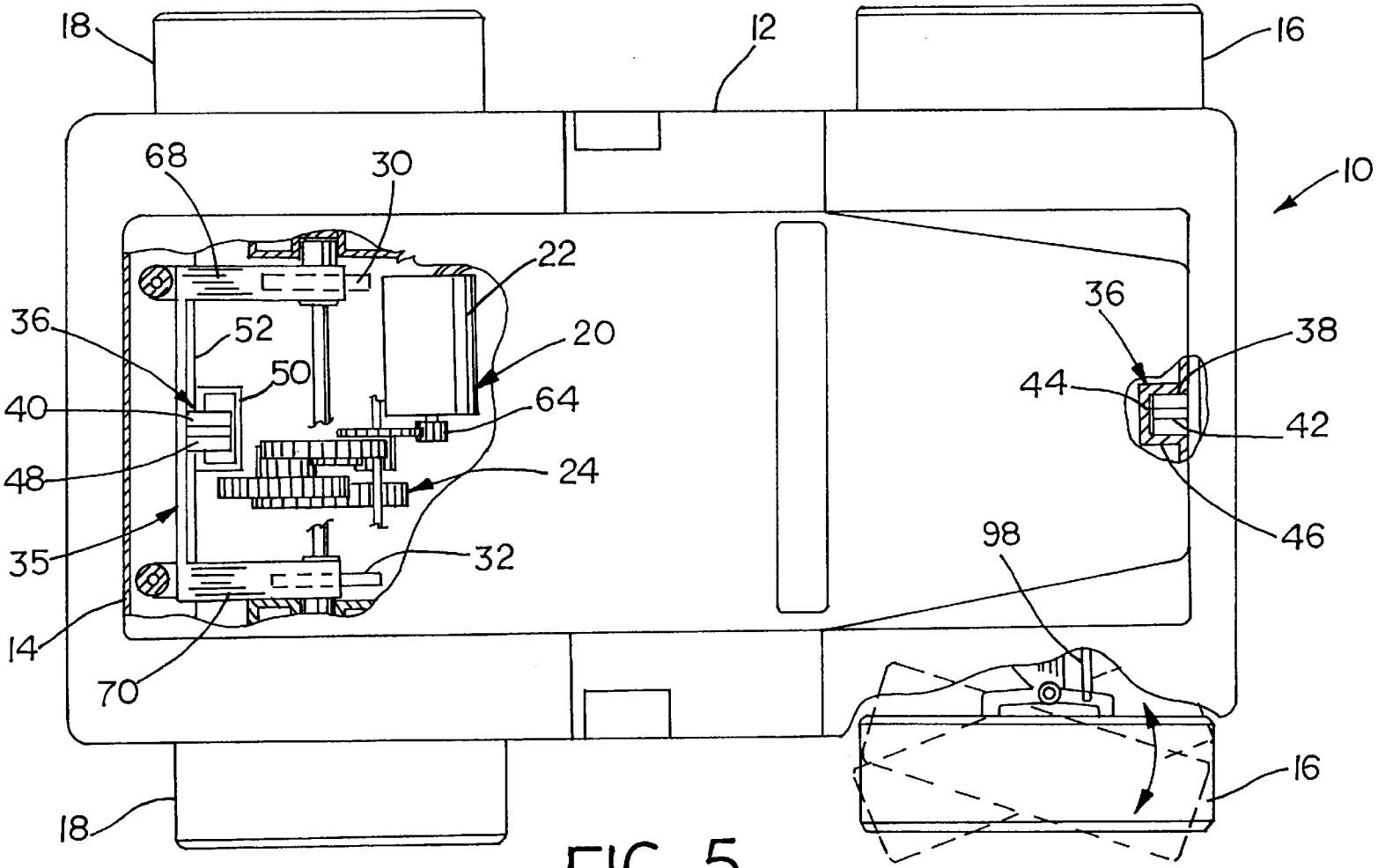
FIG. 5 is a top plan view of a toy vehicle with portions of the body cut away to reveal the motor drive assembly, the actuating cam and the cam follower.

As shown in FIGS. 4 and 5, the body 12 is mounted to the chassis 14 by a hinge assembly 36 which, for the embodiment shown, consists of a front hinge or pivot 38 and a rear hinge or pivot 40. The front pivot 38 includes a post 42 molded into the body 12 and sized to be received in a corresponding housing 44 on the front end 46 of the chassis 14. Similarly, the rear pivot 40 includes a post 48 molded into the body 12 and sized to be received in a corresponding housing 50 on the rear end 52 of the chassis 14. Preferably, the cam follower 35 is integral with the rear pivot 40 as can be seen in FIGS. 4, 5 and 6. Accordingly, the body 12 is pivotable relative to the chassis 14 between a left-tilted position shown in FIG. 2 and a right-tilted position shown in FIG. 3 in a manner discussed more fully below. The left-tilted and right-tilted positions are also shown in phantom in FIG. 1. As such, the body 12 is adapted to rotate or pivot about an axis generally parallel to a longitudinal axis of the toy vehicle 10. Alternatively, the hinge assembly 36 may be constructed so as to permit the body 12 to pivot about an axis perpendicular to the longitudinal axis of the toy vehicle 10. Preferably, the body 12 is constructed so as to simulate the appearance of an all-terrain or off-road vehicle. Alternatively, other body styles may be chosen.

Referring now to FIGS. 6 and 7, the gear train 24 includes a plurality of spur gears 54, 56, 58, 60 and 62, which are arranged in a manner well known to those of skill in the art in order to impart rotational motion from the motor 22 to the drive wheels 18 as well as to the camshaft 28 of the actuating cam assembly 26. The drive motor 22 includes a drive gear 64 which drives idler gears 54 and 56 in order to impart driving force to an axle 66 connecting the rear wheels 18, thereby rotating the rear wheels in response to operation of the drive motor 22. The drive gear 64 also transmits power to the shaft 28 of the actuating cam assembly 26 via idler gears 54, 56 and 60, which rotate the shaft 28 via gear 62, thereby rotating the cam members 30, 32. Alternatively, a plurality of helical gears or a worm drive arrangement may be employed. Further, additional or fewer gears and/or idler gears may be employed as necessary as would be apparent to one of skill in the art depending on the dictates of the application.

The cam follower 35 is mounted to the body 12 and includes a pair of arms 68, 70, each of which extends over an adjacent one of the cam members 30, 32, respectively. The cam follower 35 is rigidly attached to the body 12 in order to pivot therewith in response to the tilting action caused by the lobes 34 repeatedly abutting or contacting the arms 68, 70 of the cam follower 35.

Figure 8:
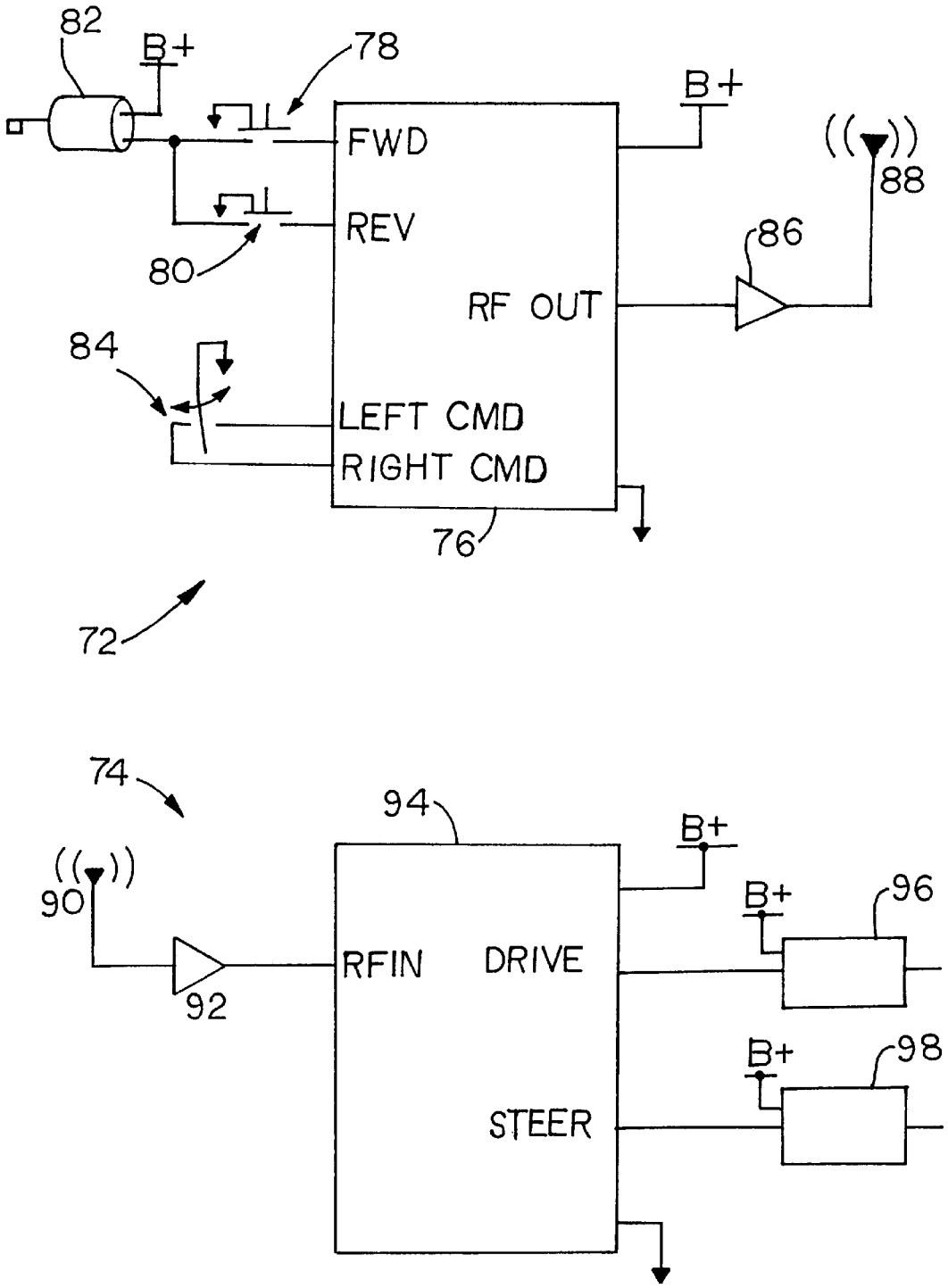
FIG. 8 is a schematic diagram of an RC control circuit for controlling the toy vehicle.

Referring now to FIG. 8, a conventional RC controller system includes a transmitter system 72 and a receiver system 74 as shown in FIG. 8. The transmitter system 74 is located inside a conventional hand-held plastic housing 71 (shown in FIG. 1) that the user (not shown) operates to control the toy vehicle 10. The transmitter system 74 includes a standard remote control transmitter integrated circuit (TXIC) 76, which generates appropriate commands for broadcast based on inputs to the TXIC 76. The TXIC 76 may be embodied in various chips such as that available from either Kin Yat, Model No. KY001 or from Real Tech, Model No. TX2, both of which are conventional commercially available systems. Two momentary switches 78 and 80 are used to send commands representative of forward and reverse, respectively. When the forward switch 78 is actuated, the switch grounds the forward pin on the TXIC 76. Actuation of the forward switch 78 causes the TXIC 76 to send a forward command. Similarly, actuation of the reverse switch 80 grounds the reverse pin on the TXIC 76 and causes the TXIC 76 to send a reverse command.

A pendulum switch 84 is provided to send left or right commands to the TXIC 76. When the user tilts the hand-held housing to the left, the grounded center of the pendulum switch grounds the left command pin of the TXIC 76. Similarly, when the hand-held housing is tilted to the right the pendulum contacts the right command pin of the TXIC 76. Grounding of either the left or the right command pins causes the appropriate commands to be sent to the vehicle. Forward, reverse, left and right commands are all generated on the RF out pin of the TXIC 76. The RF out pin is connected to an RF amplifier 86, which amplifies the command signals for transmission by an antenna 88.

The commands generated by the transmitter system 72 are received by an antenna 90 of the receiver system 74. The signals are coupled from the antenna 90 to a RF amplifier 92, which appropriately amplifies the signals for use by a RXIC 94. The RXIC 94 is typically part of the chipset that includes the TXIC 76. RXICs 94 may be obtained from Kin Yat, Model No. KY011, or from Real Tech, Model No. RX2. Again, such chipsets are conventional and commercially available. The RXIC 94 receives signals from the RF amplifier 92 and interprets the signals according to the communication scheme used between the TXIC 76 and the RXIC 94 to determine the commands sent by the transmitter system 72. Depending on the commands received, the RXIC 94 actuates either the drive motor 22 to drive the rear wheels 18 of the toy vehicle 10 or a servo motor 98 (visible in FIG. 5) which causes the front wheels 16 of the toy vehicle 10 to turn in a conventional manner, thus enabling the user to remotely steer the toy vehicle 10 as the vehicle is being operated.

In operation, the toy vehicle 10 is actuated by depressing a button 100 on the controller 71 and which is operatively connected to switches 78 and 80 as outlined above, which commences operation of the drive motor 22. As shown in FIGS. 6 and 7, rotation of the drive motor 22 in the direction shown will rotate the rear wheels 18 in the indicated direction, thus causing the toy vehicle 10 to proceed in a forward direction (i.e., generally to the right of FIGS. 6 and 7). Rotational movement is imparted to the axle 66, and hence to the rear wheels 18, via the gear 64 on the drive motor 22, to the idler gears 54 and 56, and then to the final drive gear 58 mounted to the axle 66. The toy vehicle 10 will then proceed in the desired direction at a desired speed along a desired path. Operation of the drive motor 22 in the opposite direction from that indicated will naturally have the opposite result (i.e., the toy vehicle 10 will proceed in a rearward direction, which is generally to the left of FIGS. 6 and 7).

During the operation of the drive motor 22, rotational movement is simultaneously imparted to the camshaft 28 of the actuating cam assembly 26 via idler gears 54, 56 and 60 to the drive gear 62 connected to the camshaft 28, which thus causes the camshaft 28 to rotate. In the process, the cam members 30, 32 also rotate about the axis of the shaft 28, thereby bringing each of the lobes 34 of the cam members 30, 32 into alternating abutting contact with the adjacent arm 68, 70 of the cam follower 35. The contact of one of the cam lobes 34 against an adjacent one of the arms 68 or 70 causes the cam follower 35 to rotate or see-saw about the rear pivot 40. By virtue of the cam members 30, 32 being offset about the shaft 28 relative to each other, a lobe 34 from the left cam member 30 will contact the left arm 68, followed by a lobe 34 from the right cam member 32 contacting the right arm 70, resulting in the left-right, see-saw oscillation. As each lobe 34 contacts the adjacent arm 68 or 70, the respective arm is pushed upwardly which causes the body to rotate or pivot about the front and rear pivots 38, 40 of the hinge assembly 36. By virtue of this alternating left-right contact and by virtue of the hinge assembly 36, the rotation of the actuating cam assembly 26 thus causes the body 12 to tilt or pivot back and forth in response to operation of the drive motor 22 of the motor drive assembly 20.

It will be understood that the above description does not limit the invention to the above-given details. It is contemplated that various modifications and substitutions can be made without departing from the spirit and scope of the following claims

What is claimed:

1. A toy vehicle, comprising:

a chassis having a plurality of wheels;

a motor drive assembly mounted to the chassis and being operatively connected to at least one of the wheels;

a body mounted to the chassis by a hinge, the hinge permitting the body to pivot about the hinge; and an actuating cam having a plurality of lobes, the actuating cam being operatively connected to the motor drive assembly and engaging the body to thereby impart pivotal movement to the body about the hinge in response to operation of the motor drive assembly.

2. The toy vehicle of claim 1, wherein the actuating cam includes three lobes.

3. The toy vehicle of claim 1, wherein the actuating cam is adapted to pivot the body about the hinge at a rate proportional to a speed of the vehicle.

4. The toy vehicle of claim 1, wherein the hinge includes a front pivot mounted adjacent a front end of the chassis and further includes a rear pivot mounted adjacent a rear end of the chassis.

5. The toy vehicle of claim 1, in combination with an RC controller for controlling the motor drive assembly, the RC controller being shiftable between a forward mode and a reverse mode.

6. A toy vehicle, comprising:

a chassis having a plurality of wheels;

a motor carried by the chassis;

a gear train operatively connecting the motor to at least one of the wheels;

a body mounted to the chassis;

a pivot mechanism including a front pivot disposed adjacent a front end of the body and a rear pivot disposed adjacent a rear end of the body, the pivot mechanism being adapted to permit the body to pivot relative to the chassis exclusively about a single longitudinal axis extending between the front pivot and the rear pivot; and an actuator operatively connected to the gear train and engaging the body, the actuator thereby moving the body about the pivot in response to operation of the motor, so that the body alternately pivots between a first pivoted position and a second pivoted position at a rate proportional to the speed of the vehicle.

7. The toy vehicle of claim 6, including an RC controller for remotely controlling the operation of the motor drive assembly.

8. A toy vehicle having an oscillating body, comprising:

a chassis having a plurality of wheels;

a drive motor operatively connected to at least one of the wheels, the drive motor being adapted to propel the vehicle along a path;

a body mounted to the chassis by a pivot assembly, the body having a front end and a rear end, the pivot assembly including a single front pivot disposed toward the front end of the body and a single rear pivot disposed toward the rear end of the body, the front and rear pivots being spaced along a central longitudinal axis extending between the front pivot and the rear pivot, the front and rear pivots being adapted to permit the body to pivot about the axis; and an actuator operatively connecting the drive motor and the body, the actuator being adapted to oscillate the body about the pivot assembly in response to operation of the drive motor as the toy vehicle along a path.

9. A toy vehicle, comprising:

a chassis having a plurality of wheels;

a motor drive assembly mounted to the chassis and being operatively connected to at least one of the wheels;

a body mounted to the chassis by a hinge, the hinge permitting the body to pivot about the hinge; and an actuating cam operatively connected to the motor drive assembly and engaging the body, the actuating cam including a pair of cam members mounted to a common camshaft, each of the cam members including a cam lobe, the lobe of each cam member being staggered about the camshaft relative to the lobe of the other cam member, each of the cam member lobes further being disposed to abut an adjacent side portion of the body, thereby alternately pivoting the body about the hinge in opposite directions in response to operation of the motor drive assembly.

10. The toy vehicle of claim 9, wherein each of the cam members includes three cam lobes.

11. A toy vehicle, comprising:

a chassis having a plurality of wheels;

a motor drive assembly mounted to the chassis and being operatively connected to at least one of the wheels;

a body pivotally mounted to the chassis by a hinge, the hinge including a front pivot mounted adjacent a front end of the chassis and further including a rear pivot mounted adjacent a rear end of the chassis, the body further including a cam follower; and an actuating cam operatively connected to the motor drive assembly and being adapted to engage the cam follower to thereby impart pivotal movement to the body about the hinge in response to operation of the motor drive assembly.

12. A toy vehicle, comprising:

a chassis having a plurality of wheels;

a motor carried by the chassis;

a gear train operatively connecting the motor to at least one of the wheels;

a body mounted to the chassis;

a pivot mechanism adapted to permit the body to pivot relative to the chassis exclusively about a single longitudinal axis; and an actuator operatively connected to the gear train and engaging the body, the actuator including a rotating cam having a plurality of lobes, the actuator thereby moving the body about the pivot in response to operation of the motor, so that the body alternately pivots between a first pivoted position and a second pivoted position at a rate proportional to the speed of the vehicle.

13. The toy vehicle of claim 12, wherein the cam includes three lobes.

14. A toy vehicle, comprising:

a chassis having a plurality of wheels;

a motor carried by the chassis;

a gear train operatively connecting the motor to at least one of the wheels;

a body mounted to the chassis;

a pivot mechanism adapted to permit the body to pivot relative to the chassis exclusively about a single longitudinal axis; and an actuator operatively connected to the gear train and engaging the body, the actuator including a pair of cam members mounted to a common rotatable camshaft, each of the cam members including a cam lobe, the cam lobe of each cam member being staggered about the camshaft relative to the cam lobe of the other cam member, each of the cam lobes further being disposed to coact with an adjacent portion of the body, each adjacent body portion being disposed on opposing sides of the pivot mechanism, the rotating camshaft thereby alternately pivoting the body about the pivot mechanism in opposite directions in response to operation of the motor;

whereby the body alternately pivots between a first pivoted position and a second pivoted position at a rate proportional to the speed of the vehicle.

15. The toy vehicle of claim 14, wherein each of the cam members includes three cam lobes.

16. A toy vehicle, comprising:

a chassis having a plurality of wheels;

a motor carried by the chassis;

a gear train operatively connecting the motor to at least one of the wheels;

a body mounted to the chassis;

a pivot mechanism adapted to permit the body to pivot relative to the chassis about a longitudinal axis, the pivot mechanism including a front pivot pin mounted adjacent a front end of the chassis and a rear pivot pin mounted adjacent a rear end of the chassis; and an actuator operatively connected to the gear train and engaging the body, the actuator thereby moving the body about the pivot mechanism in response to operation of the motor, so that the body alternately pivots between a first pivoted position and a second pivoted position at a rate proportional to the speed of the vehicle.

17. The toy vehicle of claim 16, wherein the body includes a cam follower mounted adjacent the rear end of the vehicle.

* * * * *